US005080625A

United States Patent [19]

Huffhines

[11] Patent Number: 5,080,625

[45] Date of Patent: Jan. 14, 1992

[54] BALLOON TARGET AND PISTOL

[76] Inventor: Terry W. Huffhines, 7862 Darnell, Lenexa, Kans. 66215

[21] Appl. No.: 647,238

[22] Filed: Jan. 29, 1991

[51] Int. Cl.[5] ..... A63H 3/06; A63H 27/00; A63H 33/30; A63B 67/20

[52] U.S. Cl. ..... 446/225; 446/231; 446/475; 273/349

[58] Field of Search ..... 446/220, 221, 222, 223, 446/224, 225, 226, 230, 231, 232, 267, 475; 273/349, 350, 369, 370, 386

[56] References Cited

U.S. PATENT DOCUMENTS

| | | | |
|---|---|---|---|
| 344,515 | 6/1886 | Biehl | 446/225 |
| 3,009,286 | 11/1961 | Warner | 446/267 X |
| 3,153,878 | 10/1964 | Smith, Jr. | 446/230 X |
| 3,399,485 | 9/1968 | Cashavelly et al. | 446/15 |
| 3,591,975 | 7/1971 | Terc | 446/225 |
| 3,605,329 | 9/1971 | Dalli | 446/225 |
| 3,733,738 | 5/1973 | Kramer | 446/267 |
| 4,038,777 | 8/1977 | Schwartz | 446/225 |
| 4,077,629 | 3/1978 | Chestney | 273/349 |
| 4,145,838 | 3/1979 | Mason | 446/225 X |
| 4,307,537 | 12/1981 | Bergmann | 446/222 |
| 4,356,661 | 11/1982 | Calderwood | 446/230 X |
| 4,533,145 | 8/1985 | Liebman | 273/349 X |
| 4,573,938 | 3/1986 | Sassak | 446/231 X |
| 4,891,029 | 1/1990 | Hutchinson | 446/225 X |
| 4,946,415 | 8/1990 | Huang | 446/225 |
| 5,031,908 | 7/1991 | Spector | 446/225 X |

*Primary Examiner*—D. Neal Muir

*Attorney, Agent, or Firm*—Litman, McMahon & Brown

[57] ABSTRACT

A balloon toy apparatus contains a lighter-than-air gas, causing it to rise. Wetting the toy with a controlled amount of a volatile liquid, such as water ejected from a water pistol, overcomes the tendency to rise and results in the toy descending or floating at or near neutral buoyancy. Evaporation of the liquid reestablishes the tendency to rise.

18 Claims, 1 Drawing Sheet

Fig. 1.
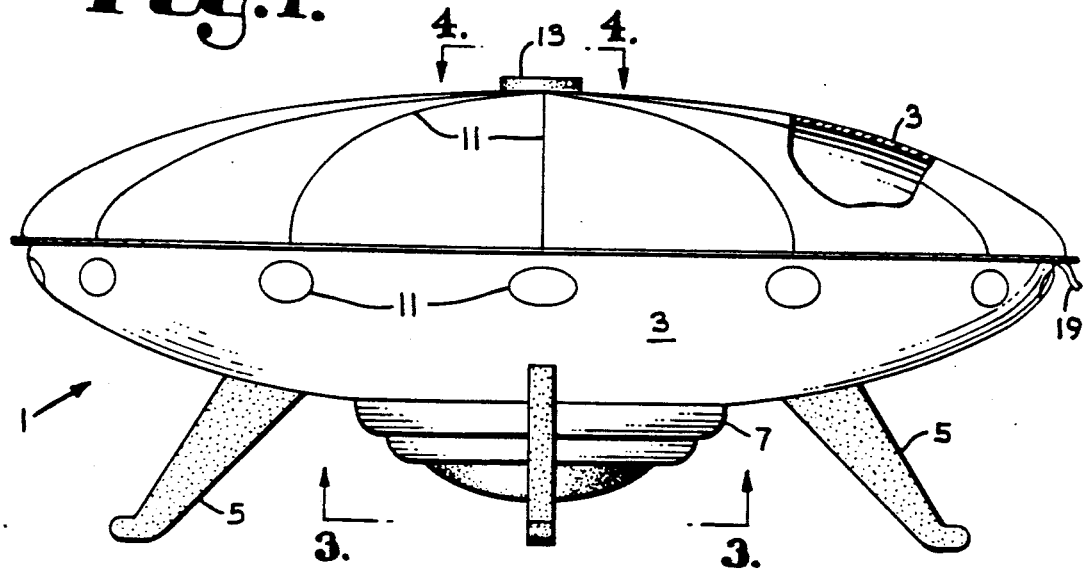
Fig. 2.
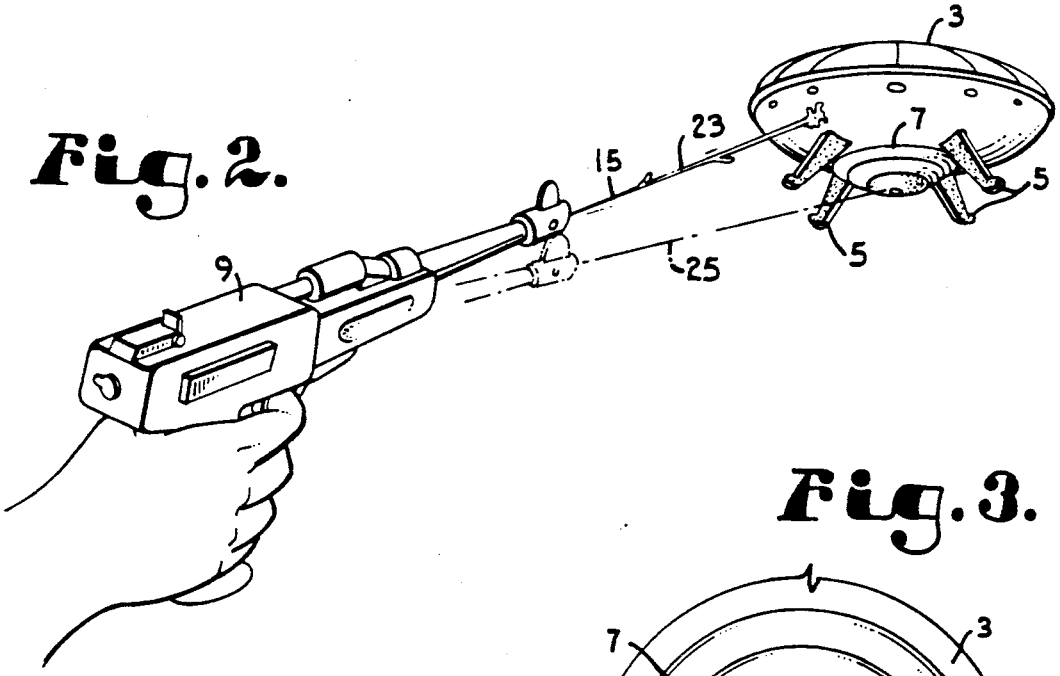
Fig. 3.
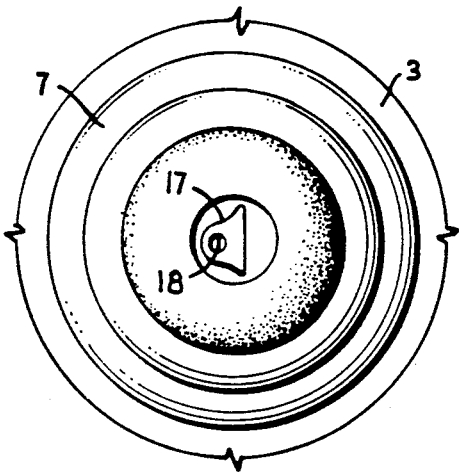
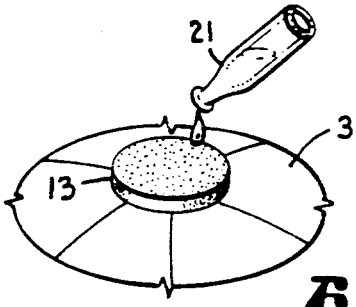
Fig. 4.

BALLOON TARGET AND PISTOL

BACKGROUND OF THE INVENTION

Three dimension movement has customarily provided a high degree of fascination for most human beings. As a result of such fascination, various devices have been developed to demonstrate such activity.

An increasingly common sight are the helium-filled mylar balloons which carry congratulatory or motivational messages to young and old alike. Such balloons usually provide nothing more than an original thrill provided by the initial surprise and thereafter continue to waft about in the air currents of its environment to the extent permitted by its tethering cord until the helium diffuses out of the balloon, causing the fascination previously caused by its positive buoyancy to vanish.

What is needed is an apparatus which not only has a revivable positive buoyancy but also has arbitrarily alterable buoyancy characteristics whereby a user of the apparatus is provided with an amusing and entertaining opportunity to develop or practice eye-hand coordination skills.

SUMMARY OF THE INVENTION

A balloon toy apparatus is provided for developing or challenging the eye-hand coordination skills of a user. The apparatus comprises an inflatable container or balloon constructed of a non-absorbent material which is substantially impervious to lighter-than-air gases such as helium, an understructure constructed of lightweight material, at least a portion of which material is absorbent, and a buoyancy adjuster, which is also constructed of lightweight absorbent material. A remote anti-buoyancy ejector, suCh as a water pistol, is provided to selectively effect a temporary change in the buoyancy of the apparatus from positive to negative.

The balloon is substantially shaped like an oblate spheroid with the understructure, consisting of a set of legs and a simulated cupola, symmetrically secured to the balloon about one end of the axis thereof and the buoyancy adjuster symmetrically Secured about the other end of the axis thereof. The balloon is substantially inflated whereby sufficient buoyancy is created to overcome the composite gravitational attraction of the balloon, the understructure and the buoyancy adjuster. The net positive buoyancy of the apparatus is then adjusted by adding sufficient counterbalancing weight, such as by causing water to be absorbed by the buoyancy adjuster whereby the apparatus normally has a slightly positive buoyancy which can be converted to a negative buoyancy by squirting the apparatus with the water pistol.

When the ambient relative humidity is low whereby moisture evaporates relatively rapidly, water from the water pistol is squirted on the absorbent understructure of the apparatus causing the apparatus to lose altitude because of the net negative buoyancy of the apparatus caused by the added weight of water absorbed by the understructure. The extra water squirted on the understructure immediately begins to evaporate, allowing the apparatus to slowly regain its net positive buoyancy and to again ascend in altitude.

When the ambient relative humidity is high whereby moisture evaporates relatively slowly, water from the water pistol is squirted on the non-absorbent material of the balloon causing the desired temporary, net negative buoyancy. As a result of the water being more exposed than it would be if it is squirted on the absorbent material of the understructure, the water evaporates more quickly. Thus, substantially similar time responses of the apparatus for regaining a positive buoyancy are obtainable for use of s the apparatus in both high relative humidity and low relative humidity conditions.

The water pistol has a fine control such that the quantity of water discharged onto the apparatus can be closely controlled in order to avoid coarser buoyancy modifications by the water pistol than desired.

The apparatus also includes a tab which can optionally be used either to attach a fixed weight thereto, which provides a non-volatile buoyancy adjustment capability, or to tether the apparatus such that it can be used for its intended purposes without being undesirably whisked away by ambient air currents.

OBJECTS AND ADVANTAGES OF THE INVENTION

Therefore, the objects of the present invention are: to provide an apparatus for developing and practicing eye-hand coordination skills; to provide such an apparatus for providing amusement and entertainment; to provide such an apparatus having buoyancy characteristics which can be temporarily selectively converted from positive to negative by a remotely controlled source of volatile liquid; and to generally provide such an apparatus which is relatively inexpensive to manufacture, reliable in performance, and performs in accordance with its intended purposes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a side elevational view of a balloon toy apparatus in accordance with the present invention, with a portion cut away to reveal details thereof.

FIG. 2 is a perspective view showing the balloon toy apparatus being squirted with a water pistol.

FIG. 3 is a bottom plan view of the balloon toy apparatus, taken along line 3—3 of FIG. 1.

FIG. 4 is an enlarged, top perspective view of the balloon toy apparatus in accordance with the present invention, taken along line 4—4 of FIG. 1.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a balloon toy apparatus in accordance with the present invention, as shown in FIGS. 1 through 4. The apparatus 1 comprises positive buoyancy means, such as an inflatable balloon or container 3, orientation means, such as an understructure or set of legs 5, anti-buoyancy means, such as a simulated cupola 7, and a remote control mechanism, such as a water pistol or a liquid ejector or applicator 9.

The inflatable container 3 is constructed of a thin, lightweight, flexible, non-absorbent material or skin 10, such as a polyester film as provided by E. I. DuPont de Nemours & Co. under the trademark Mylar, or other suitable material, which is substantially impervious to a lighter-than-air gas, such as helium. The container 3 is generally constructed such that, when inflated, it assumes a "flying saucer", or oblate spheroid, shape as illustrated in FIG. 1. It is to be understood, however, that the present invention is not dependent upon the container 3 assuming any particular shape; as a result, the container 3 can assume a multitude of sizes and shapes while providing the intents and purposes of the present invention. Various indicia 11 are painted, printed, or otherwise provided on the outer surface of the container 3 as desired.

The legs 5 are constructed of lightweight material, such as foam rubber, or other suitable material, and are generally spaced symmetrically about the axis of the container 3 such that the axis of the container 3 is generally oriented vertically. The legs 5 are secured to the container 3 by glue, or other suitable means, as illustrated in FIG. 1.

The cupola 7 is constructed of absorbent, lightweight material, such as foam rubber, or other suitable material, and is generally spaced symmetrically about the axis of the container 3 in close proximity to the legs 5. The cupola 7 is secured to the container 3 by glue, or other suitable means.

The cupola 7 is illustrated in FIGS. 1-3 as having the appearance of a pair of rings and a dome having a common axis. It is to be understood that the cupola 7 can be configured in any of a multitude of other shapes as desired.

A buoyancy adjuster 13 is constructed of absorbent, lightweight material, such as foam rubber or other suitable material, and is generally spaced symmetrically about the axis of the container 3 at the opposite end thereof from the legs 5 and the cupola 7. The buoyancy adjuster 13 is secured to the container 3 by glue, or other suitable means. The adjuster 13 has sufficient absorption capacity such that the net buoyancy of the apparatus 1, after the container 3 has been inflated, is only slightly positive whereby the net buoyancy of the apparatus 1 can be changed to a negative buoyancy by activation of the anti-buoyancy means as hereinafter described.

The liquid ejector 9 contains an internal reservoir (not shown) which is constructed such that a user can selectively and arbitrarily cause a volatile liquid contained in the ejector 9 to be discharged in a narrow and well-defined, directed stream 15 over a substantial distance, as illustrated in FIG. 2. Such reservoir has sufficient capacity to contain a sufficient quantity of such liquid to serially discharge a plurality of the streams 15 without refilling.

A tab 17, having a throughbore 18, is secured along one edge thereof to the container 3 by glue, or suitable means. The tab 17 can be optionally used to tether the apparatus if desired.

In an actual application of the present invention, the container 3 is inflated by injecting helium into the closed cavity or interior chamber of the container 3 through a self-sealing valve or inlet 19 by commonly known methods. The container 3 is so inflated until it assumes its designed shape without over-inflation, which might otherwise tend to rupture the container 3.

Water 21, or other suitable liquid, is then caused to be absorbed by the buoyancy adjuster 13 such as by an eye-dropper or the like, as illustrated in FIG. 4. The quantity of the water 22 absorbed by the adjuster 13 is dependent upon the desired number of streams 15 impacting with the apparatus 1 which is required to overcome the adjusted, net positive buoyancy of the apparatus 1. If it is desired that only a single stream 15 is required to generate a net negative buoyancy for the apparatus 1, then a greater amount of the water 21 is added to the adjuster 13 than if it is desired that more than one of the streams 15 is required to generate such net negative buoyancy for the apparatus 1.

The apparatus 1 With its adjusted, net positive buoyancy is then released in the vicinity where the eye-hand coordination activity is to be conducted. Upon such release, the apparatus 1 drifts upwardlY as a result of the net positive buoyancy. If it is desired to limit the amount of such upward movement or to limit lateral movement arising from ambient air currents, then acord (not shown) or other suitable means may be secured to the tab 17 to tether the apparatus 1.

The water pistol 9 is filled with water and adjusted such that a well-defined stream 15 is selectively dischargeable therefrom. The user then aims the pistol 9 at the apparatus 1. If the relative humidity is high, the pistol 9 is preferably aimed such that the stream 15 discharged by the pistol 9 impacts with the container 3, as illustrated by the solid line referenced by the numeral 23 in FIG. 2. As a result, the water impacting with the container 3 is relatively exposed and, therefore, will evaporate more quickly than it would if absorbed by the cupola 7. If the stream 15 should impact with the absorbent cupola 7 instead of directly with the container 3, a longer response time is observed before sufficient water evaporates whereby the apparatus I regains its net positive buoyancy and again drifts upwardly.

On the other hand, if the relative humidity is low, the pistol 9 is preferably aimed such that the stream 15 discharged by the pistol 9 impacts with the cupola 7, as illustrated by the dashed line referenced by the numeral 25 in FIG. 2. As a result, the water which is absorbed by the cupola 7 is relatively shielded or unexposed and, therefore, will evaporate more slowly than it would if adsorbed by the container 3. If the stream 15 should impact with the non-absorbent container 3 instead of with the cupola 7, a shorter response time is observed before sufficient water evaporates whereby the apparatus 1 regains its net positive buoyancy. The user can arbitrarily select either the container 3 or the cupola 7 as his or her target, depending on the response time desired for the existing ambient relative humidity.

The legs 5 can also be constructed of absorbent material. In that event, the quantity of the water 21 placed in the adjuster 13 ca be selected such that the desired number of the streams 15 required to generate a net negative buoyancy for the apparatus 1 is the same as the number of legs 5 of the apparatus 1. Then, the challenge for the user is to successfully impact a single stream 15 with each of the legs 5 in order to generate the net negative buoyancy. A variety of other challenges are possible, limited only by the imagination of the user.

It is to be understood that while certain forms of the present invention have been illustrated and described herein, it is not to be limited to the specific forms or arrangement of parts described and shown.

What is claimed and desired to be secured by Letters Patent is as follows:

1. A toy comprising:
(a) buoyancy means for providing positive gaseous aerial buoyancy characteristics for said toy;
(b) anti-buoyancy means for providing temporary, volatile net negative buoyancy characteristics for said toy whereby when a liquid makes contact with said anti-buoyancy means, net negative buoyancy may be attained and upon evaporation of said liquid a positive buoyancy is regained, thereby controlling said aerial buoyancy; and
(c) a remote control mechanism comprising a liquid projecting device for remotely and temporarily activating said anti-buoyancy means.

2. The toy according to claim 1 wherein said buoyancy means include:
(a) an inflatable container for containing a lighter-than-air gas; said container having a valve for injecting such gas into said container.

3. The toy according to claim 2 wherein:
(a) said container is constructed of polyester film.

4. The toy according to claim 2 wherein said buoyancy means include:
(a) a positive buoyancy adjuster.

5. The toy according to claim 4 wherein:
(a) said positive buoyancy adjuster is constructed of absorbent material.

6. The toy according to claim 1 wherein said toy includes:
(a) an understructure which maintains said toy in an upright orientation.

7. The toy according to claim 1 wherein said anti-buoyancy means include:
(a) an understructure constructed of absorbent material; said understructure being adapted to absorb a sufficient quantity of a volatile liquid such that said toy temporarily exhibits a net negative buoyancy.

8. The toy according to claim 1 wherein said remote control mechanism includes:
(a) a volatile liquid; and
(b) a device for containing said liquid; said device being capable of selectively discharging a controlled stream of said liquid.

9. The toy according to claim 8 wherein:
(a) said device is a water pistol.

10. The toy according to claim 8 wherein:
(a) said volatile liquid is water.

11. A toy comprising:
(a) a closed container having an interior chamber defined by a thin skin;
(b) a lighter-than-air gas in said chamber and normally providing aerial buoyancy to said container;
(c) an ejecting applicator having a volatile liquid therein;
(d) said applicator being adapted to direct said volatile liquid against said container while spaced therefrom, thereby wetting said container and temporarily adding sufficient weight thereto such that the net buoyancy thereof is reduced to zero or less, whereupon evaporation of said volatile liquid reverses said reduction of the net buoyancy.

12. The toy according to claim 11 wherein:
(a) said container is a balloon.

13. The toy according to claim 12 wherein:
(a) said skin is constructed of polyester film.

14. The toy according to claim 11 wherein:
(a) said gas is helium.

15. The toy according to claim 1 wherein:
(a) said applicator is a water pistol.

16. The toy according to claim 15 wherein:
(a) said volatile liquid is water.

17. A toy for developing and practicing eye-hand coordination of a user, comprising:
(a) a flexible, closed container; said container having a cavity and an inlet to said cavity; said container constructed of non-absorbent material which is substantially impervious to a lighter-than-air gas; said container generally having the shape of an oblate spheroid;
(b) a source of lighter-than-air gas for inflating said container by injecting said gas through said inlet;
(c) a set of legs secured to said container; said legs spaced substantially symmetrically about the axis of said container; said legs supporting said toy in an upright position when said legs abut a substantially horizontal planar surface; said legs constructed of lightweight material;
(d) a simulated cupola secured to said container; said cupola spaced substantially symmetrically about the axis of said container in close proximity to said legs; said cupola constructed of lightweight, absorbent material such that said toy exhibits a net positive buoyancy when said container is inflated with said gas and said cupola is substantially dry and said toy exhibits a net negative buoyancy when said container is similarly inflated with said gas and said cupola has absorbed a selected quantity of a volatile liquid;
(e) a buoyancy adjuster secured to said container; said adjuster spaced substantially symmetrically about the axis of said container opposite from said set of legs; said adjuster constructed of absorbent material such that a sufficient quantity of a liquid can be absorbed thereby such that the net buoyancy of said toy after said container is inflated with said gas can be adjusted to exhibit a small positive buoyancy;
(f) a liquid ejector for remotely selectively causing the net buoyancy of said toy to temporarily change from a positive buoyancy to a negative buoyancy; said ejector containing volatile liquid; said ejector adapted to controllably discharge a stream of said volatile liquid and direct said stream of liquid such that said stream of liquid impacts with said toy; said ejector containing a sufficient quantity of said liquid for serially discharging a plurality of said streams of liquid; and
(g) a tab on said container for optionally tethering said toy.

18. A toy comprising:
(a) buoyancy means for providing positive buoyancy characteristics for said toy;
(b) anti-buoyancy means for providing volatile net negative buoyancy characteristics for said toy; and
(c) a remote control mechanism for activating said anti-buoyancy means,
(d) said buoyancy means including an inflatable container for containing a lighter-than-air gas; said container having a valve for injecting such gas into said container, (e) said container being constructed of non-absorbent material; said container having an outer surface adapted to adsorb a sufficient quantity of a volatile liquid to cause said toy to temporarily exhibit a net negative buoyancy, (f) said anti-buoyancy means including a positive buoyancy adjuster constructed of absorbent material.

* * * * *